US005254911A

United States Patent [19]

Avnery et al.

[11] Patent Number: 5,254,911

[45] Date of Patent: Oct. 19, 1993

[54] PARALLEL FILAMENT ELECTRON GUN

[75] Inventors: Tzvi Avnery, Winchester; Willem van de Stadt, Salem; Michael J. Souza, Fall River, all of Mass.

[73] Assignee: Energy Sciences Inc., Wilmington, Mass.

[21] Appl. No.: 796,479

[22] Filed: Nov. 22, 1991

[51] Int. Cl.[5] ..... G09G 1/04; H01J 29/70; H01J 3/14; G21K 1/08

[52] U.S. Cl. ..... 315/366; 313/422; 250/396 ML

[58] Field of Search ..... 315/366, 14; 313/422, 313/363, 361, 272, 343; 250/311, 396 R, 396 ML, 492.3, 398

[56] References Cited

U.S. PATENT DOCUMENTS 3,702,412 11/1972 Quintal ..... 313/299
3,746,909 7/1973 Runtzel et al. ..... 315/14
3,749,967 7/1973 Douglas-Hamilton et al. ..... 315/85
3,863,163 1/1975 Farrell et al. ..... 328/233
3,956,712 5/1976 Hant ..... 313/343
4,077,054 2/1978 Endriz ..... 315/383
4,100,450 7/1978 Frutiger et al. ..... 313/360
4,719,388 1/1988 Oess ..... 315/366
4,812,716 3/1989 Miyama et al. ..... 315/366

*Primary Examiner*—Gregory C. Issing
*Attorney, Agent, or Firm*—Rines and Rines; Shapiro and Shapiro

[57] ABSTRACT

A novel parallel-filament type electron gun for electron beam irradiation accelerators or generators and the like having a plurality of longitudinally extending parallel transversely spaced substantially co-planar similar filaments for generating electrons and disposed between a lower co-extensive extractor grid and an upper co-extensive electrostatic lens surface for shaping the electron beam profile, and with constructional features that enable variable width and extremely wide guns to be achieved and with improved beam uniformity.

17 Claims, 14 Drawing Sheets

PARALLEL FILAMENT ELECTRON GUN

The present invention relates to electron beam gun structures for such purposes as treating or irradiating electron beam curable coatings and inks, and surface sterilization and related applications, being more particularly concerned with parallel heated filament constructions.

BACKGROUND OF INVENTION

The art is replete in many areas of electron beam generation with various types of heated filament electron beam sources of varied configurations. Single filament guns are described, for example, in U.S. Pat. Nos. 3,702,412 and 4,100,450 of common assignee herewith, and are embodied in Energy Sciences Inc., Type ESI Gun apparatus. Multi, including parallel, filament constructions have also been proposed as in, for example, U.S. Pat. No. 3,749,967 and U.S. Pat. No. 3,863,163.

Among the typical problems due to complexity with existing multi-filament guns are: high cost, severe difficulties in alignment, relatively low efficiency and difficult maintenance. Among the typical problems with existing single filament guns is the difficulty in obtaining cross beam uniformity over large dynamic range (40:1) in very long guns.

The problem of providing an efficient, simple and reliable construction that improves uniformity of extremely wide web width (say 10 feet or more), as well as a modular construction that can ease the maintenance, has still lingered in the art.

OBJECTS OF INVENTION

It is thus an object of the present invention to provide a new and improved electron beam gun structure of the parallel filament type that obviates the above disadvantages and, to the contrary, enables ready width expansion or variation (based on product width) and also variation in length in the product flow direction (based on required dose versus line speed), all while maintaining good beam uniformity and good efficiency.

Other and further objects will be explained hereinafter and are more particularly pointed out in the appended claims.

SUMMARY

In summary, however, the invention provides an electron beam gun for producing electron beam radiation along a longitudinal direction corresponding to the direction of travel of a surface-to-be-irradiated and extending in a transverse direction across said surface, the gun having, in combination, a pair of longitudinally spaced transversely extending power bar conductors between which voltage is applied; a plurality of pairs of conductive supports electrically and mechanically connected to successive transversely spaced opposing points along the bar conductors and depending therefrom in a direction orthogonal to both the longitudinal and transverse direction; and a corresponding plurality of transversely spaced filaments, one connected between each pair of conductive supports, and all extending parallel to said longitudinal direction and powered in parallel by said voltage; extracting grid means supported in a plane parallel to the beam exit window and filaments on the window side of the filaments, and an electrostatic lens or repeller surface disposed on the other side.

Best mode and preferred designs are later explained.

DRAWINGS

The invention will now be described in connection with accompanying drawings, FIG. 1 of which is an isometric view of a preferred embodiment of electron gun embodying the features of the invention;

DESCRIPTION

Figure 1:
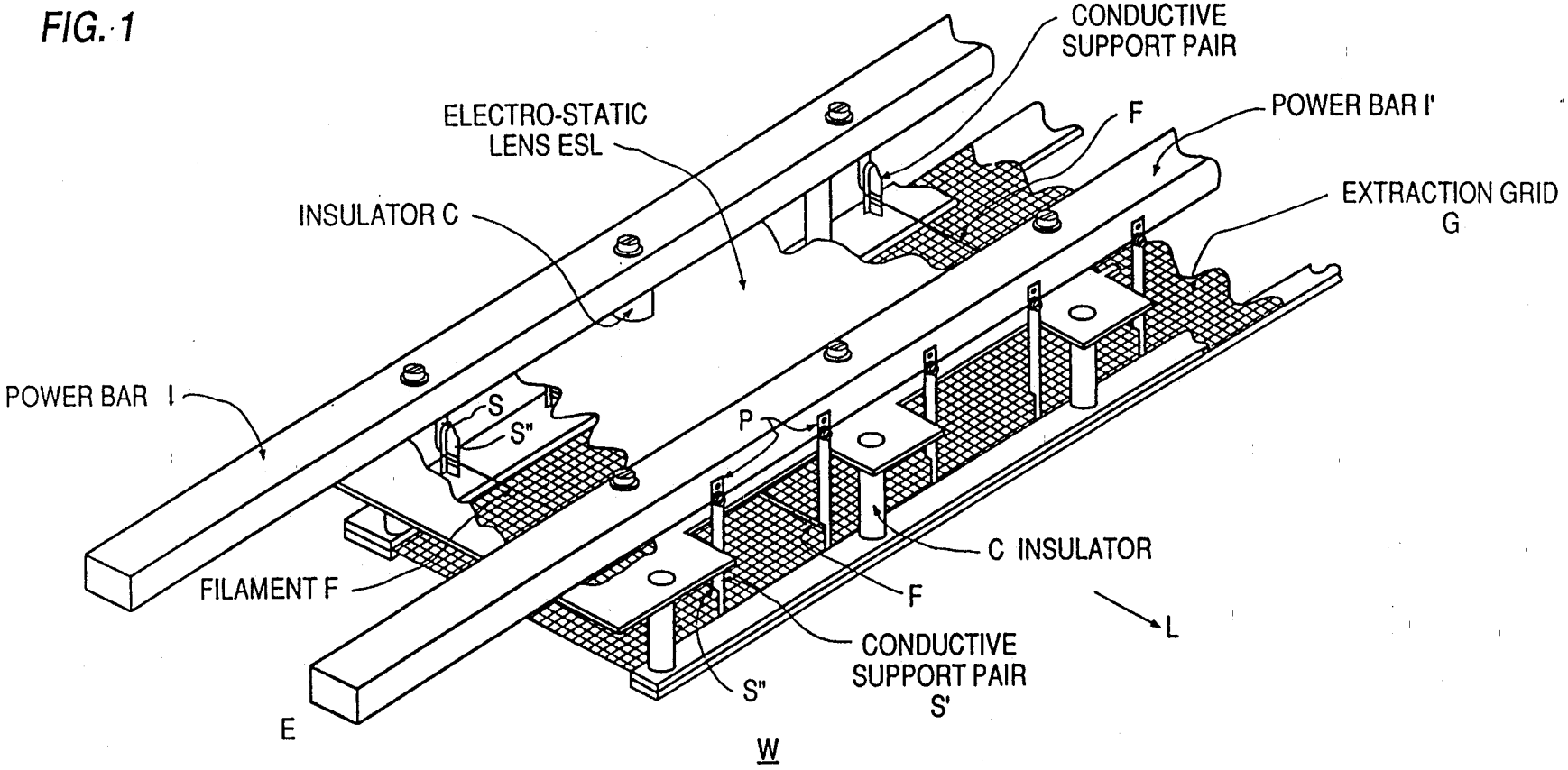

Referring to the drawings (FIGS. 1 and 2), the electron gun is shown preferably constructed about a regular parallelopiped cage of insulating supports C, supporting along spaced parallel top edges E, a pair of power bar conductors 1—1', between which a current voltage source is applied to provide heating current for the later-described gun filaments F (preferably variable voltage $V_F$ to enable appropriate filament temperatures). The cage top edges E and bar conductors 1—1' are oriented in a direction transverse to the product or web surface to be electron beam irradiated as the product or surface is moved past the gun in the longitudinal direction L below the electron beam gun anode window W.

A plurality of pairs of conductive supports S—S', electrically and mechanically connected to successive transversely spaced opposing points P along the bar conductors 1—1', is disposed to depend from the bar conductors in a downward direction orthogonal to the longitudinal and transverse directions above defined. These conductive supports S—S' serve as rigid or flexible hangers, preferably with resilient clips S'' for securing the ends of relatively short thin wire filaments F extending therebetween. Upon heating, the filaments will expand to desired length, as schematically illustrated by the dotted line positions of the hangers S—S' in FIG. 2, and later described in FIGS. 13–15. Intermediate insulating supports I may also be provided to prevent sagging as in FIG. 15.

As shown, it is preferred for purposes of beam uniformity that the successive longitudinally extending coplanar filaments F be disposed at substantially equal intervals transversely of the gun cage (and work product), say at intervals of ½" to 6". By adjusting the number of filaments at given intervals, the length of the gun can be contracted or expanded, including for extremely wide web surface or product widths of 132" or more, and with little or no effect on cross-web beam uniformity. By adjusting the longitudinal length of the filaments F, moreover, dose versus line speed accommodation can also be readily effected.

All filaments F are thus connected electrically in parallel. They are covered below by preferably a planar mesh electron extractor screen grid G, insulatingly mounted a fixed distance below the filaments F and provided with a positive DC voltage bias $V_{EX}$, the setting or value of which is variable to provide the desired extraction of electrons from the filament array through the parallel grid G to the web or other work product. The extractor grid G is substantially co-extensive with and parallel to the area of the array of filaments.

Figure 3:
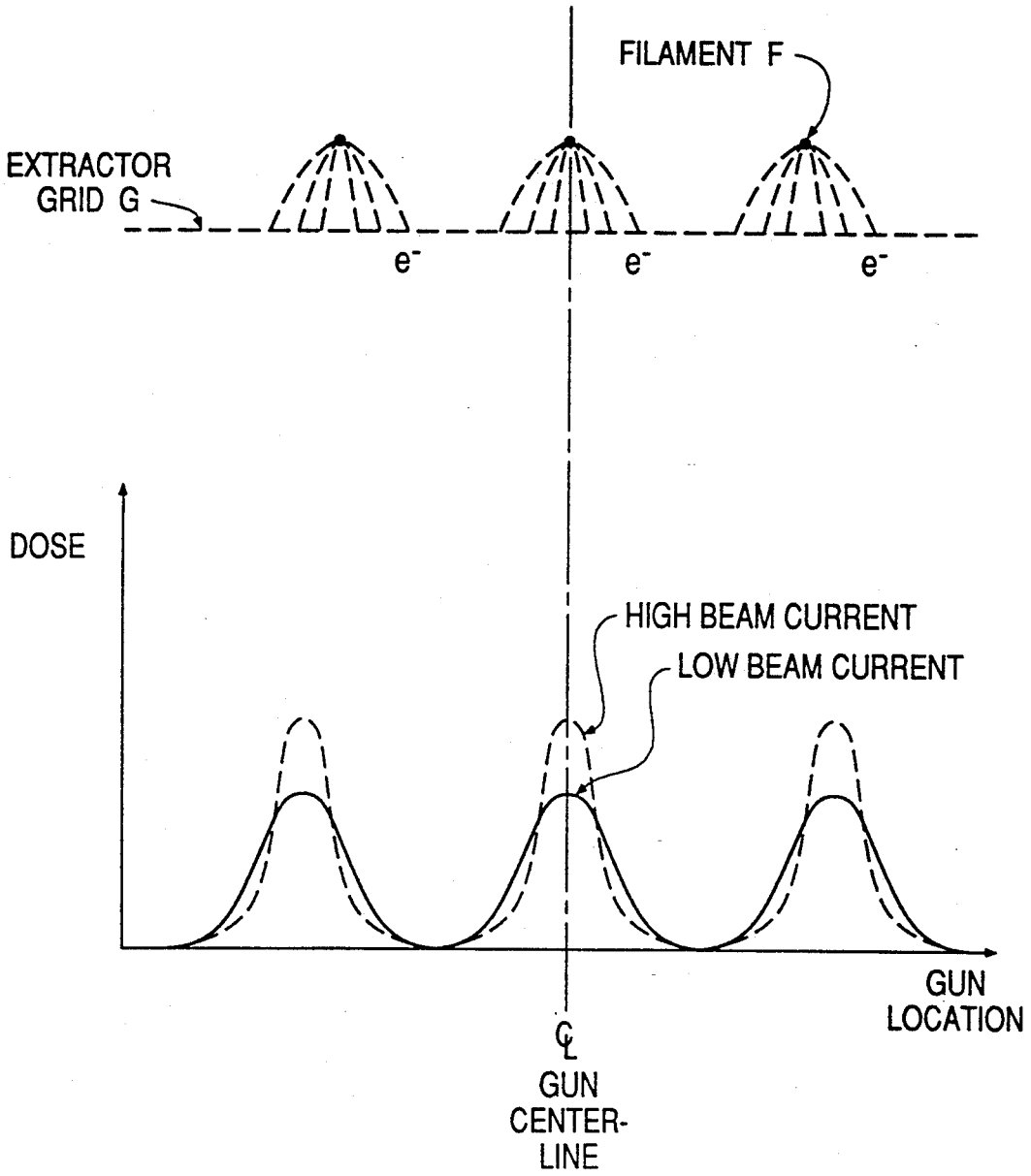
FIGS. 3 through 6 are fragmentary transverse section diagrams showing electron beam optics under different conditions of electrostatic lens use or non-use.

In accordance with the present invention, it has been found essential to use an electrostatic lens or conductive surface or repeller ESL located generally (and not limited to) in a plane on the opposite side of the extractor grid, further from the beam exit window, with the filaments F positioned between the electrostatic lens and the extractor grid. The electrostatic lens ESL will generally have a different voltage $V_{ESL}$ from that of the extractor grid $V_{EX}$ to achieve the desired electron beam uniformity. Absent the electrostatic lens ESL, the electron beam optics profile will be that of FIG. 3, with electron beam gaps between successive filament regions and peaks of beam current along the gun.

Figure 4:
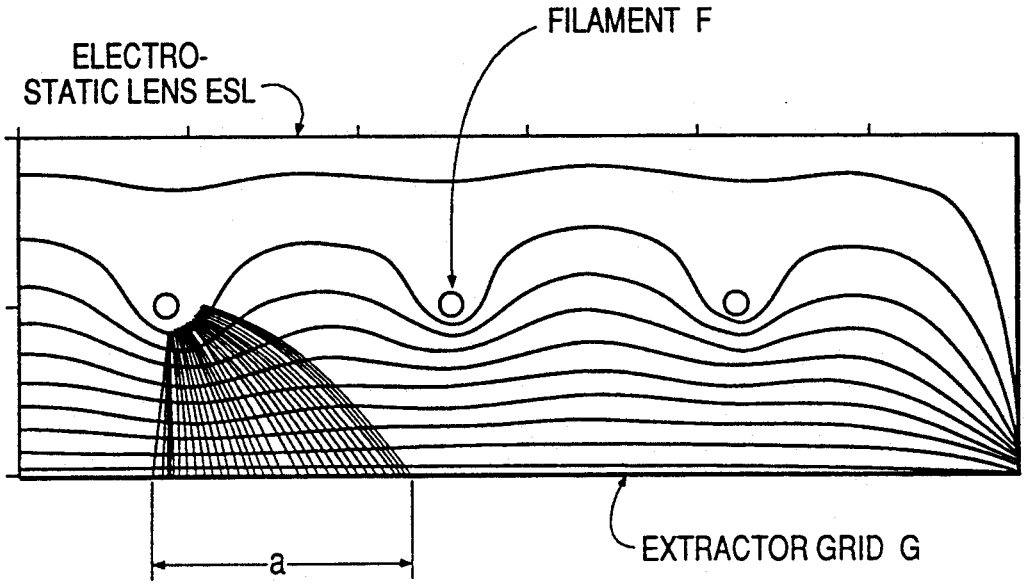
Figure 5:
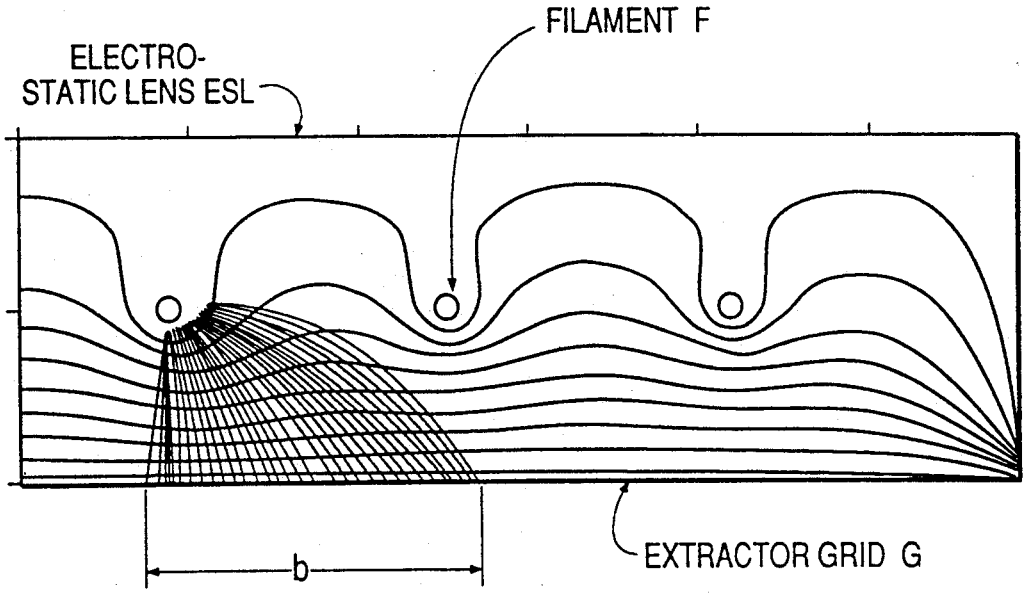
Figure 6:
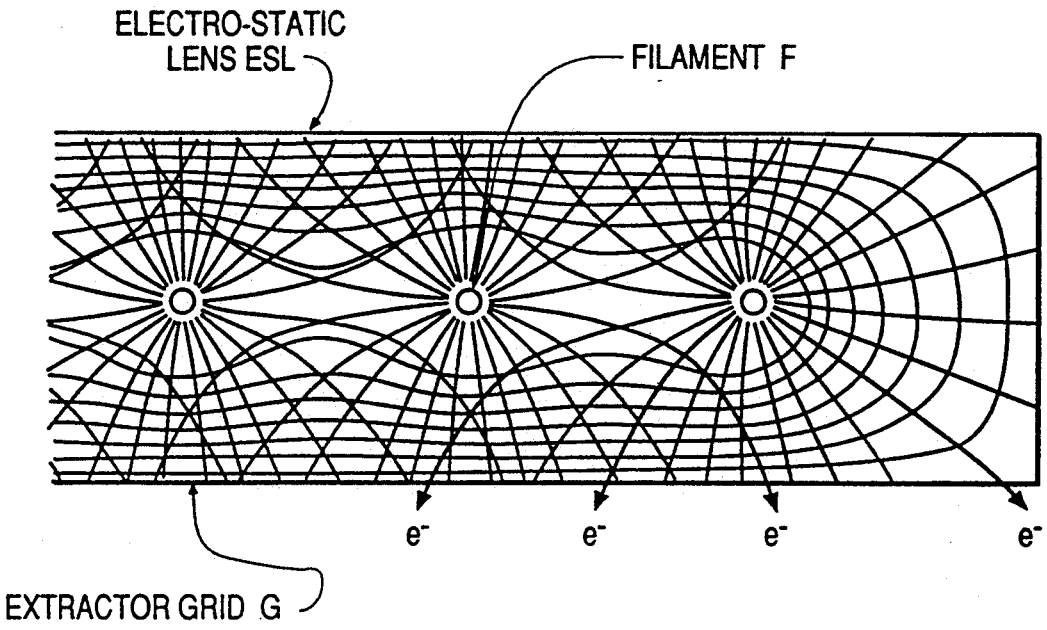
Figure 7:
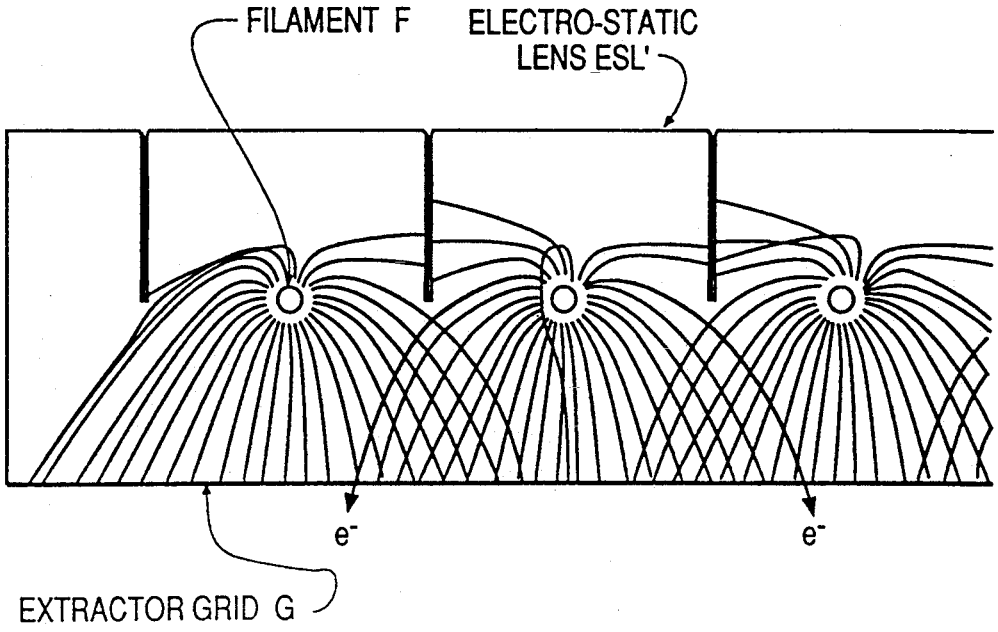
FIGS. 7 and 8 are similar diagrams for modified electrostatic lens structures.
Figure 8:
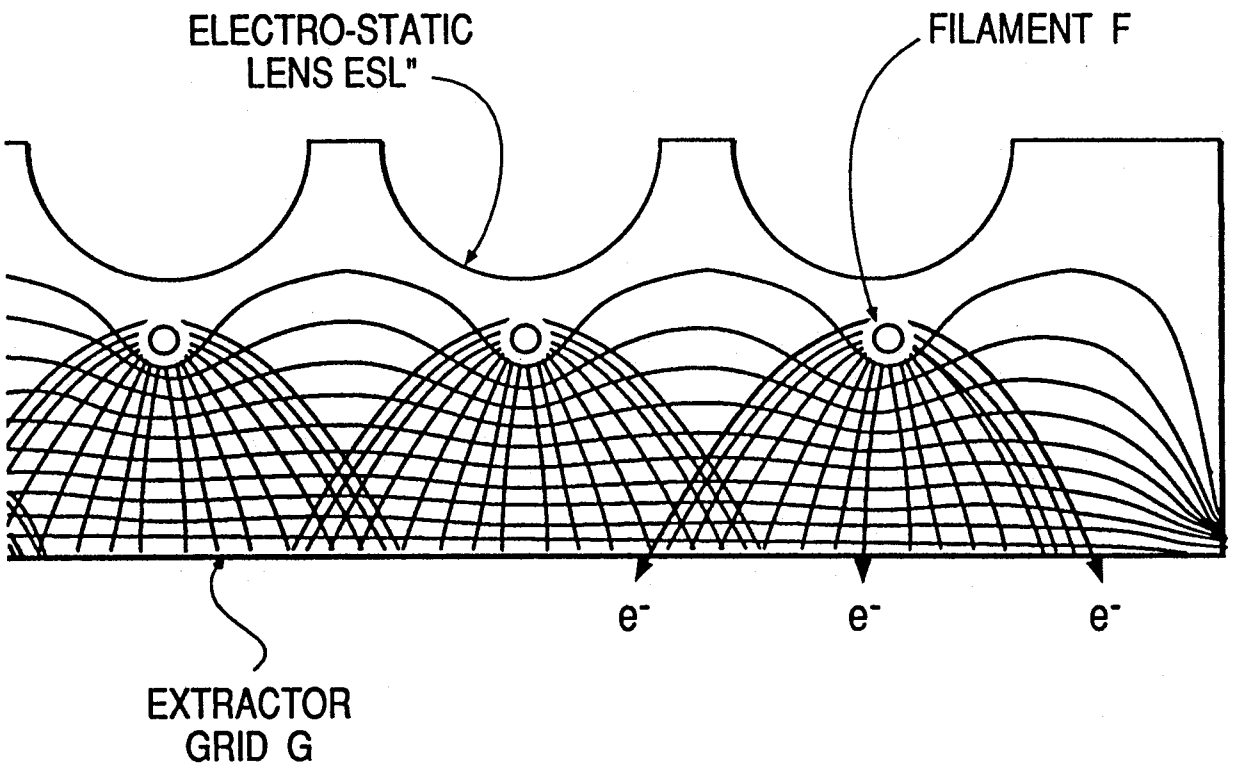

FIG. 6 shows the very different electron beam optics profile attainable with the use of the electrostatic lens ESL for the condition where the voltage $V_{ESL}$ of the electrostatic lens is equal to the voltage $V_{EX}$ of the extractor grid G. In this configuration, the electron trajectory is equally divided (except at the end) towards the extractor grid and the electrostatic lens. While this configuration shows a very good uniformity with fill-in and overlapping of the gaps and peaks, it is not considered to be efficient due to the fact that not all of the electrons are directed towards the extractor grid and therefore they are not being utilized. FIG. 4, therefore, shows the electron beam optics profile where the voltage of the electrostatic lens is made more negative in respect to the voltage of the extractor grid. Here all of the electrons are directed towards the extractor grid (and therefore towards the beam exit window), at width dimension (a). In FIG. 5, the width (b) of the electron beam directed towards the extractor grid can be varied to achieve the desired electron beam uniformity and/or the desired overlapping of electron cloud, by making the voltage on the electrostatic lens more positive than that used on electrostatic lens on FIG. 5. (For simplicity, only 180° of the electrons extracted from one filament is shown.) While preferably extending parallely over the area of the filaments, the electrostatic lens need not be strictly planar, but may also have modified contours or shapes, as shown in the successive sections ESL' of FIG. 7, and the curved channels ESL" of FIG. 8, for example, in order to get the proper or desired electron beam optics profile within the gun.

Figure 2:
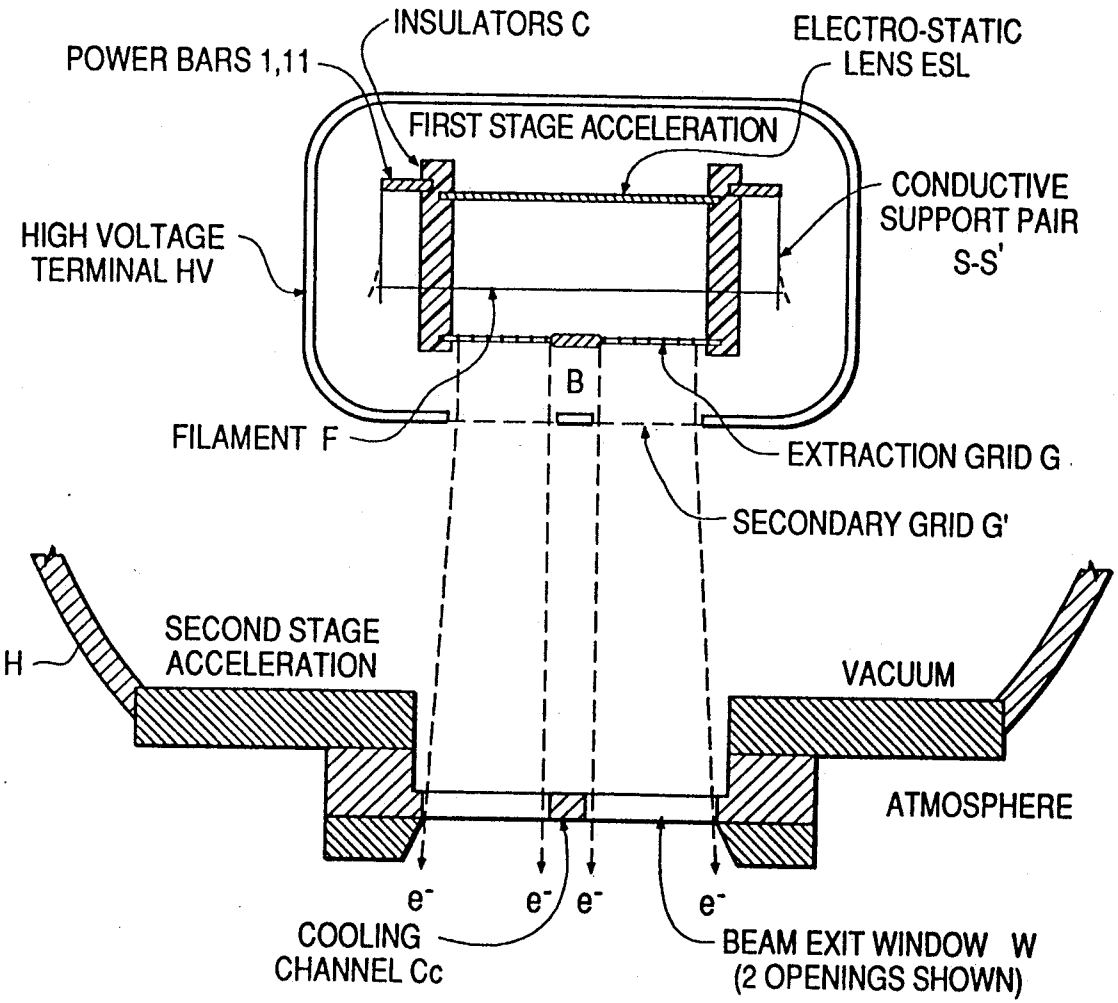
FIG. 2 is a transverse section of an electron beam accelerator employing the electron gun, and on a different scale.

The novel electron gun of FIG. 1 is shown embodied in the total accelerator housing H of FIG. 2 within a high voltage terminal HV provided with a secondary grid G', parallel to and below the extractor grid G and above the second acceleration vacuum stage that is provided with the anode beam exiting window W. The filaments F are heated, preferably by an alternating current or by a direct current or indirectly, to a temperature at which electrons are extracted therefrom. The positive voltage $V_{EX}$ applied to the extractor grid G attracts the electrons in the desired direction (shown downwardly), with the secondary grid G' having the same voltage as the extractor grid. The voltage $V_{ESL}$ on the electrostatic lens ESL is preferably different from that of the extractor grid, as earlier explained, to shape the beam profile as desired. For purposes later described in connection with the embodiments of FIGS. 13-15, each of the extraction grid G, secondary grid G' and window W is shown provided with a central blocking and/or cooling channel region B.

Figure 9:
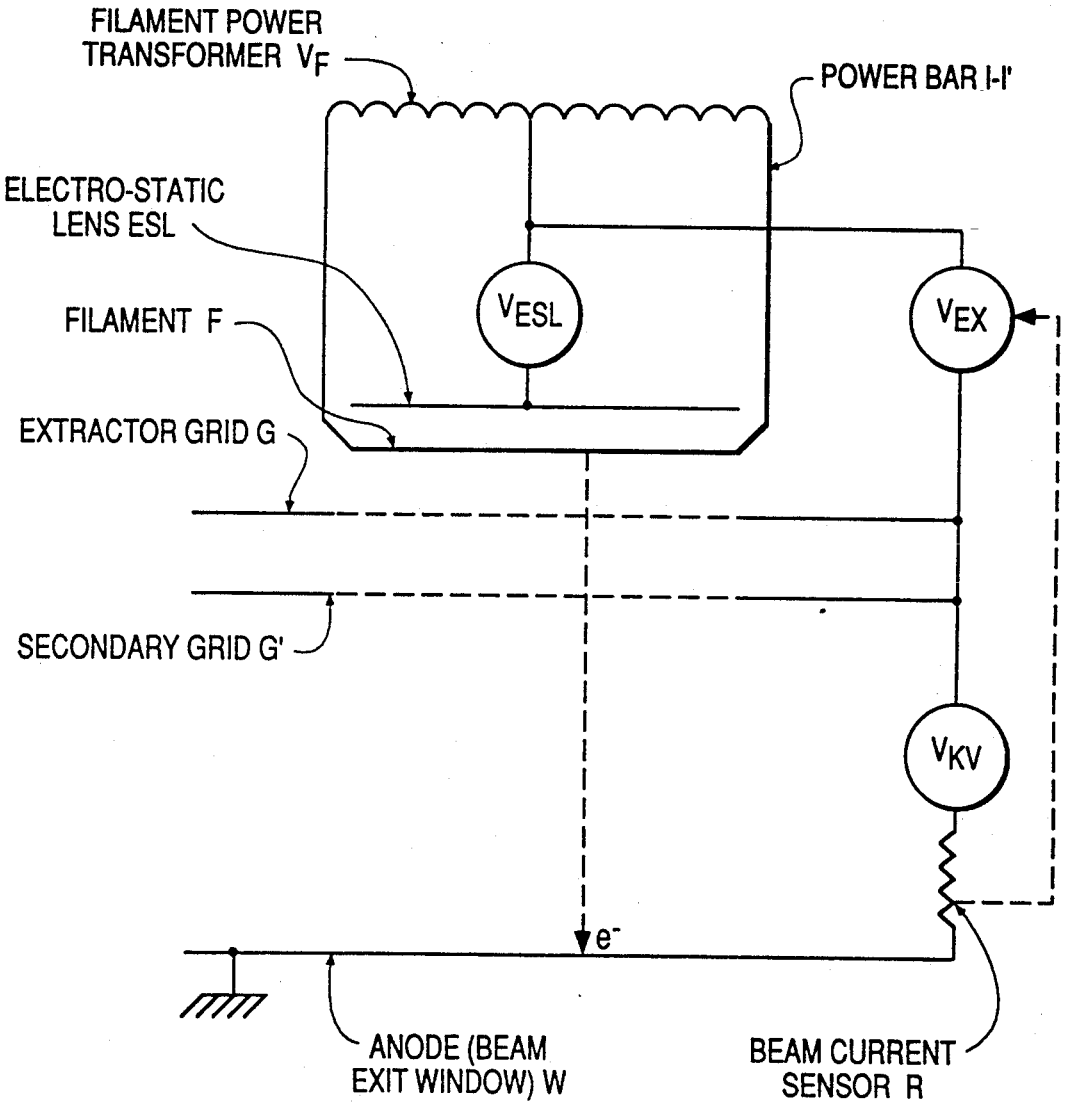
FIG. 9 is an electrical schematic diagram for the basic gun configuration shown in FIG. 1.

The voltage $V_{ESL}$ applied to the electrostatic lens can be set at a specific value, say +10 VDC, in reference to the filament. In order to be able to vary the electron beam current, the voltage $V_{EX}$ of the extractor grid has to vary. This may change the electron beam optics profile slightly within the gun. To keep the beam profile constant, the electrostatic lens voltage $V_{ESL}$ can be varied as a function of the total electron beam current. This will ensure better consistency as the accelerator runs from very low beam current to a very high beam current. Since a high voltage field is known to penetrate from the second stage acceleration into the first stage acceleration through usually employed secondary grid G', FIG. 9, the electrostatic lens voltage $V_{ESL}$ can be varied as a function of the accelerating voltage (high voltage, $V_{KV}$) to get consistency of performance for different depth of penetration applications, or it can be varied as a function of both electron beam current and accelerating voltage. In FIG. 9, a beam current sensor R is accordingly shown at the window region W with feedback control, shown dotted, to the extractor grid voltage source $V_{EX}$.

Figure 14:
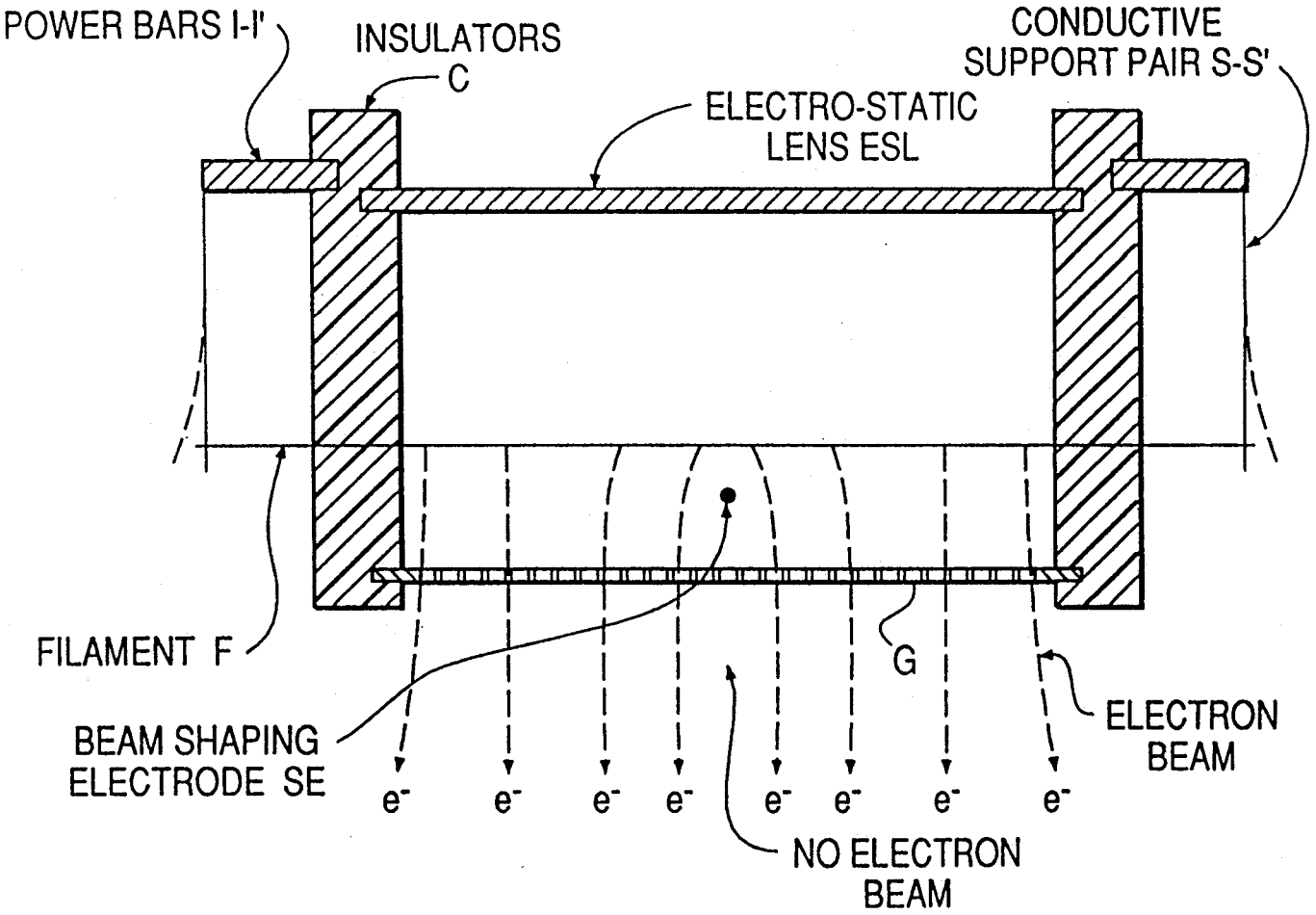
FIG. 14 is a similar transverse section showing a selective usage of the beam by diverting the beam to the needed location.

Another way to achieve the desired electron beam optics profile is by installing one or more electrical field shaping electrodes SE between the filaments F and parallel to them as in FIG. 14. This can work in addition to or sometimes in place of the electrostatic lens. The voltage applied to the field shaping electrode SE can be fixed at one value or varied as described above.

Figure 16:
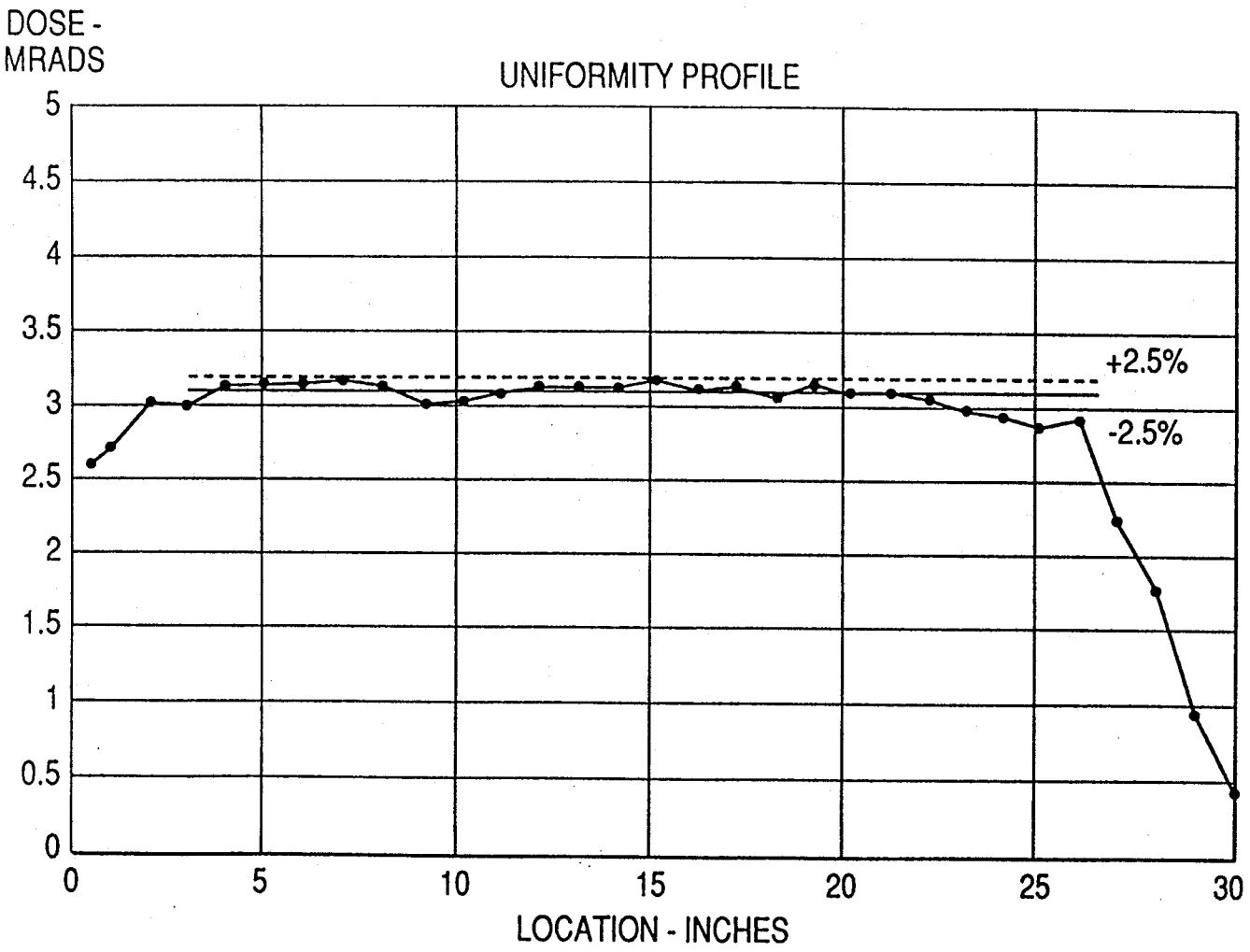
FIG. 16 is a graph of an experimentally obtained beam uniformity profile.

Uniformity of electron beam acceleration over the longitudinal direction of the gun (which is across the width of the moving product, as before stated, is of great importance. The uniformity is generally specified to be ±10% over 100" wide systems and ±7.5% over 42" wide systems. The current technology has limitations to improve the uniformity, due to the fact that all linear accelerators have passive control of uniformity. Naturally, a passive control relies heavily on tolerance, cleanliness of the system, assembly knowledge and so forth. The gun of this invention, however, has shown significant improvement of uniformity of ±2.5% when tested on older accelerators. This result is shown in FIG. 16 for a ten filament gun, as shown in FIG. 1, with 2" filament spacing.

Figure 10:
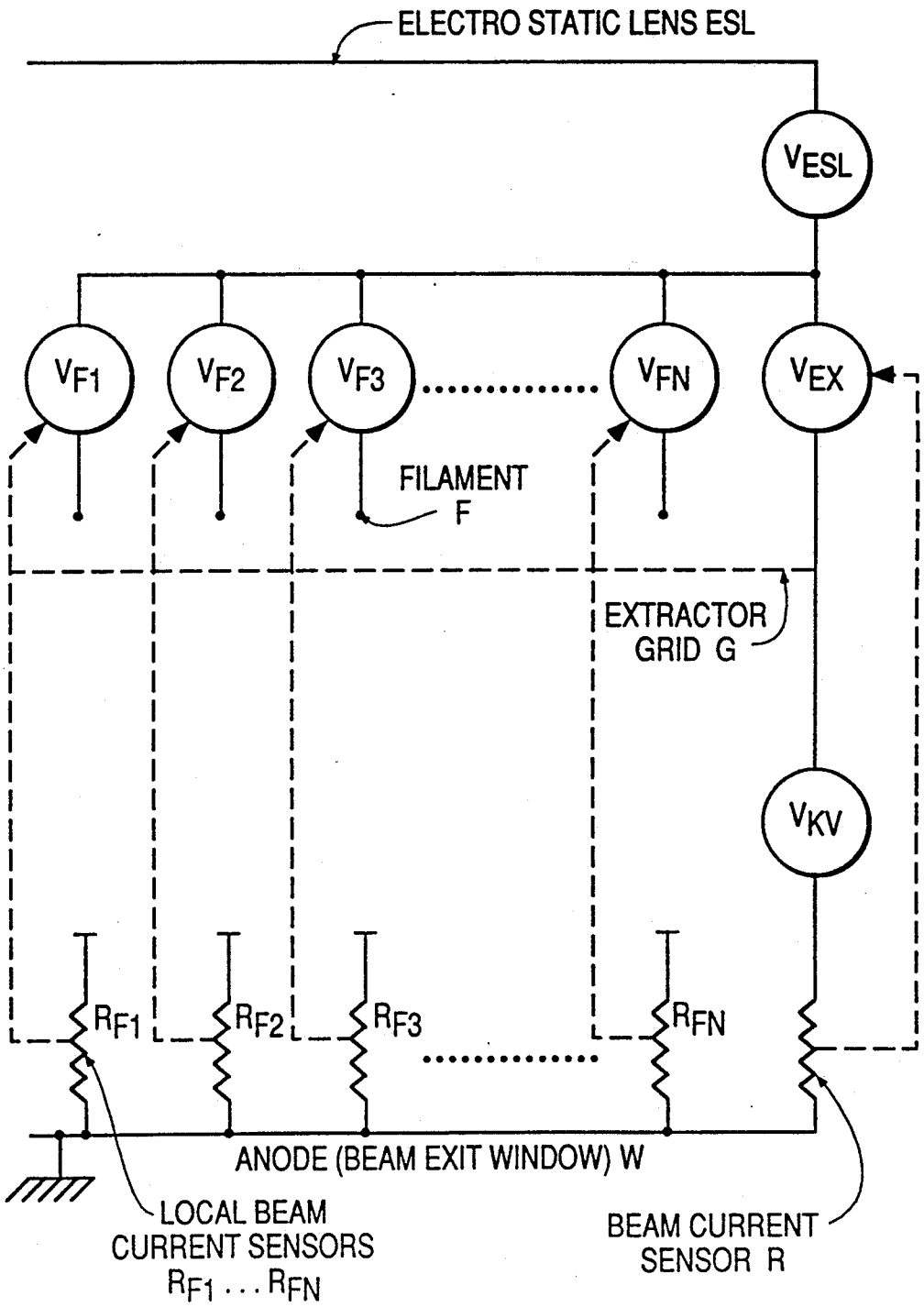
FIG. 10 is a similar electrical schematic diagram showing different filament electrical connections and control to improve beam uniformity.

In order to be less sensitive to tolerances, degree of cleanliness and assembly knowledge, and significantly to improve the uniformity (or all of the above), an active control loop in real time is desirable. FIG. 10 therefore shows the filaments F having separate control reference voltages $V_{F1}$, $V_{F2}$ . . . $V_{FN}$. The beam current sensor R of FIG. 9 is shown employed for feedback control of the extractor grid voltage $V_{EX}$ as before explained, and a plurality of local beam current sensors $R_{F1}$, $R_{F2}$ . . . $R_{FN}$ is shown provided in FIG. 10, one for each filament, to provide feedback control (shown in dotted lines) to the corresponding filament voltage sources $V_{F1}$, $V_{F2}$ . . . $V_{FN}$. These control voltages are generally small, only to overcome the differences between filaments. Also, this circuit could be connected so that the voltage on the filaments is of the magnitude of the extraction voltage, in which case $V_{EX}=0$.

Figure 11:
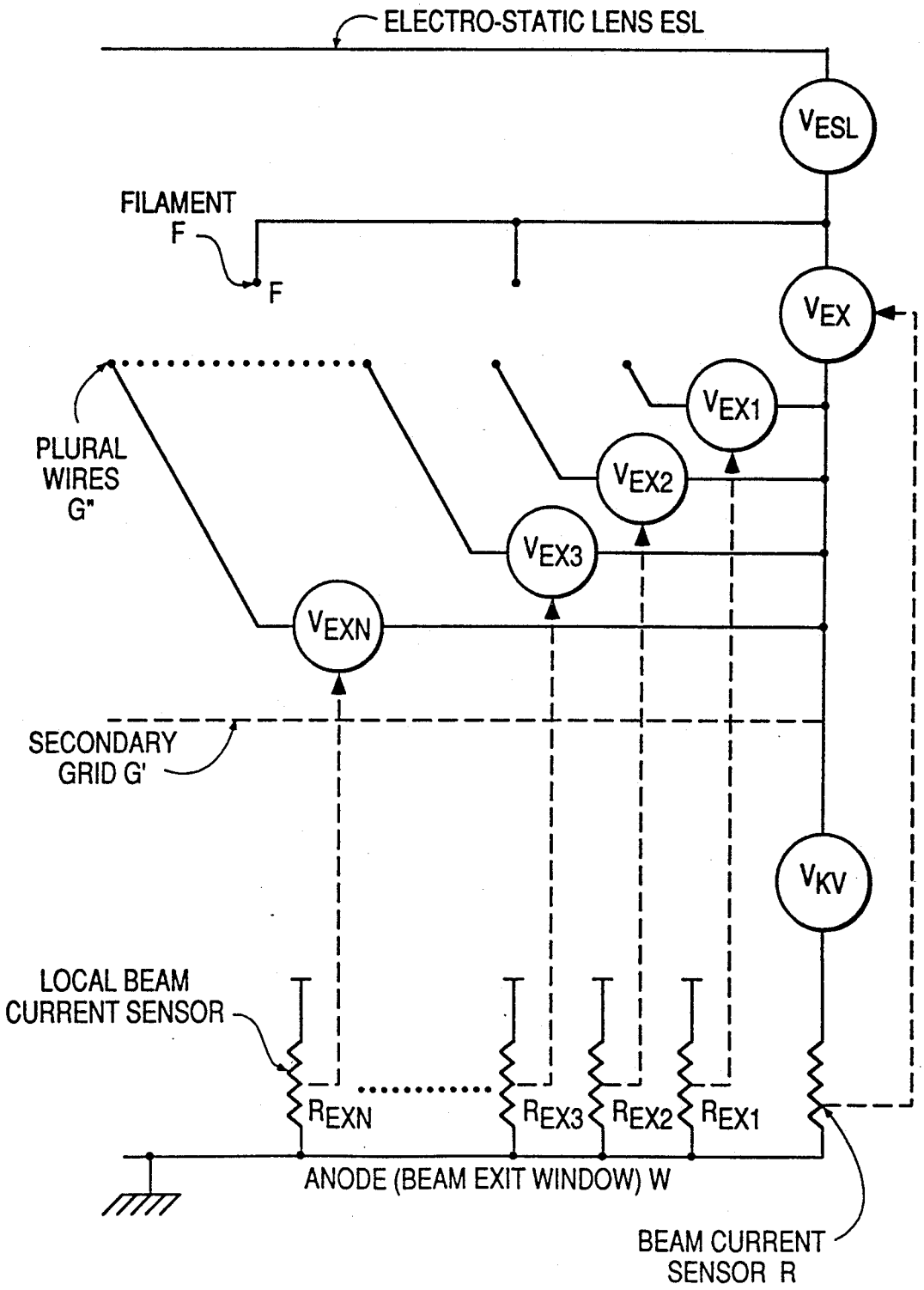
FIG. 11 is a similar electrical schematic diagram showing different extractor grid electrical connections and control to improve beam uniformity.

FIG. 11 illustrates another way to achieve the above objectives. Instead of having an extractor grid G made out of a screen, a construction G" of plural wires in a plane parallel to the filaments and to the beam exit window may be employed. Each wire is shown with its voltage $V_{EX1}$, $V_{EX2}$ . . . $V_{EXN}$ controlled separately in real time in the same manner escribed in FIG. 10, but by feedback (shown dotted) from corresponding local beam sensors $R_{EX1}$, $R_{EX2}$ . . . $R_{EXN}$.

Figure 12:
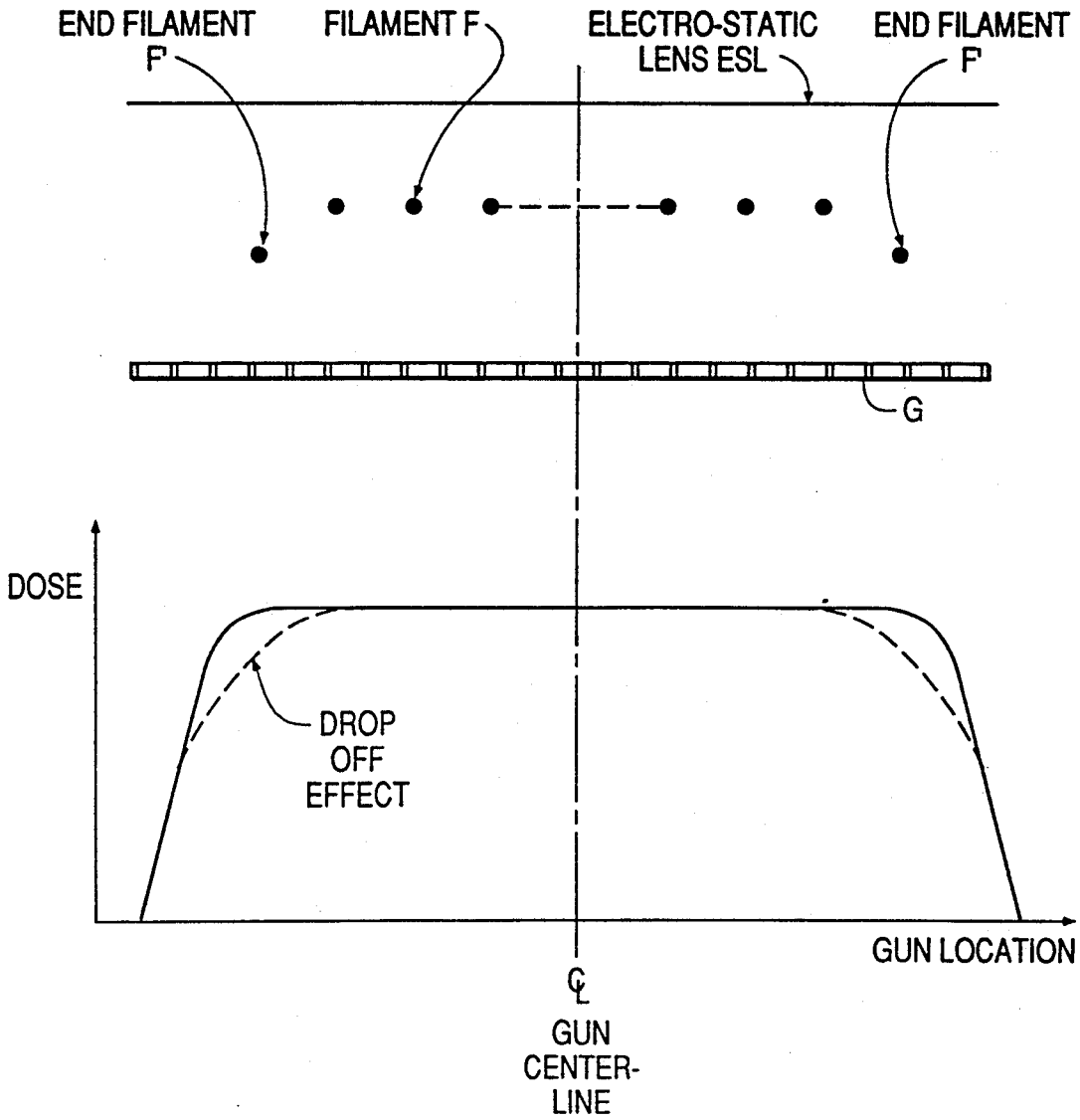
FIG. 12 is a side view showing modified positioning of the end filaments to improve the beam at the ends.

Another typical problem known in the electron beam accelerator art is the "drop off" effect at the ends of the electron beam illustrated in FIG. 12. In FIG. 12, two end filaments F' are shown positioned closer to the extractor grid G than the rest of the filaments. This solves the "drop off" effect problem and practically enables the gun to be made smaller, in the gun longitudinal direction.

Figure 13:
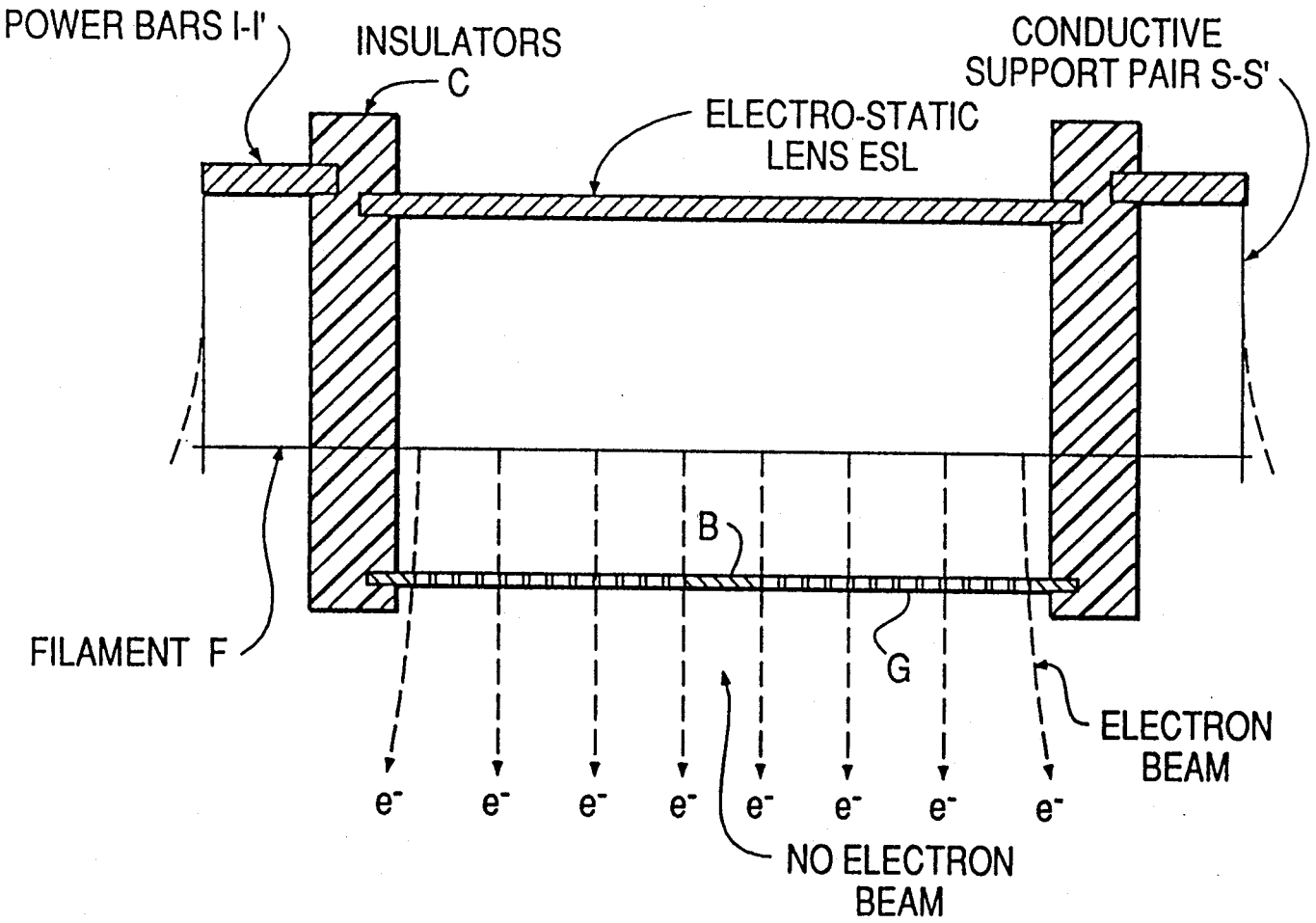
FIG. 13 is a transverse section of the gun showing selective usage of the electron beam by central blocking.
Figure 15:
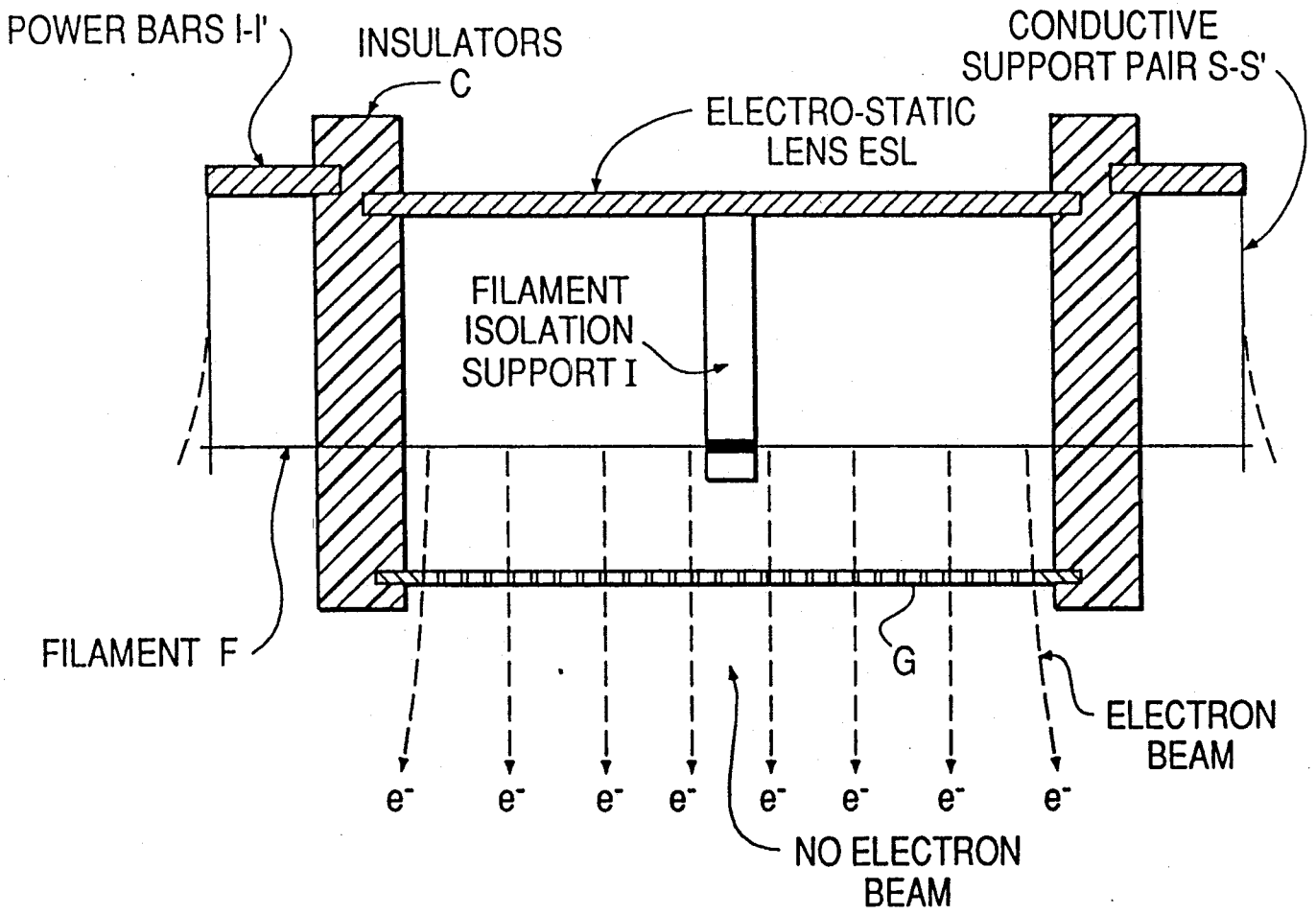
FIG. 15 is a similar transverse section showing filament insulated support construction for both mechanical advantages as well as selective usage of the electron beam by cooling.

In order to make a very wide electron beam, furthermore, a wide window opening is needed. Because of the heat load on the beam exit window W, a cooling channel CC must be constructed in the longitudinal direction of the beam exit window (typical configuration is shown in FIG. 2). It is important, therefore, to design the electron beam accelerator so that no electrons collide with the cooling channel. This reduces the heat load on the beam exit window and makes the accelerator more efficient. FIG. 13 shows one way selectively to use the electrons in the desired area by blocking the electrons in the undesired area as at B in the central region of the extractor grid G, alined with the window cooling region. FIG. 14, before discussed, shows a more efficient way by placing a beam shaping electrode SE in the longitudinal direction of the gun to guide (repel) the electron beam in the desired direction. Obviously, the number of beam shaping electrodes will match the number of cooling channels in the beam exit window. FIG. 15 additionally shows another efficient method by way of cooling through use of the before-mentioned intermediate filament insulator support I alined with the beam exit window cooling channels. This will ensure that the filament temperature is lower in this area and, therefore, electron emission does not exist in the undesired area.

Further modifications will also occur to those skilled in this art, and such are considered to fall within the spirit and scope of the invention as defined in the appended claims.

What is claimed is:

1. An electron beam gun contained within an evacuated windowed housing for generating electron beam radiation for passage through the window along a direction transverse to the longitudinal direction of travel of a surface-to-be-irradiated external to said window having, in combination, a plurality of longitudinally extending parallel transversely spaced substantially co-planar similar filaments for generating electrons upon becoming heated by current passing simultaneously therethrough; a substantially planar extractor grid spaced on one side of the filaments and substantially coextensive with the area of the filaments and of polarity positive with respect to the filaments to draw the electrons generated thereby and maintain continuous acceleration in the said transverse direction to and through the grid; means for further continuously maintaining acceleration of the electrons to and through said window externally of said housing and upon said surface-to-be-irradiated; an electrostatic lens surface spaced on the other side of the filaments and substantially coextensive with the area of the filaments and of polarity with respect to the filaments such as to modify the flow of electrons from each filament to and through the extractor grid so as to provide electron beam shaping to generate a continuous transverse electron beam of desired uniformity and profile at said window, and in which the generated electron beam is accelerated to and through an anode window upon the said surface-to-be-irradiated, said window having an intermediate cooling channel region where electrons are blocked, and electron blocking means provided at a corresponding alined region of the extractor grid.

2. An electron beam gun as claimed in claim 1 and in which means is provided for adjusting the electrostatic lens surface potential to a value different from that of the extractor grid.

3. An electron beam gun as claimed in claim 2 and in which said potential is negative with respect to that of the extractor grid.

4. An electon beam gun as claimed in claim 1 and in which said electrostatic lens surface is one of planar and contoured shape.

5. An electron beam gun as claimed in claim 1 and in which means is provided for sensing the generated beam current and, by feedback control, varying at least one of the extractor grid voltage, electrostatic lens surface voltage and filament current in accordance therewith.

6. An electron beam gun as claimed in claim 5 and in which the sensing means comprises a plurality of beam current sensors, one corresponding to each filament, and a corresponding plurality of feedback paths therefrom to control the respective filament currents.

7. An electron beam gun as claimed in claim 5 and in which the extractor grid comprises a plurality of separate wires each connected to a corresponding beam current sensor separately to control the voltage thereof.

8. An electron beam gun as claimed in claim 1 and in which a secondary grid is disposed between the extractor grid and the accelerating region leading to said window, with similarly aligned electron blocking means provided in the secondary grid.

9. An electron beam gun as claimed in claim 1 and in which the filaments are supported at their ends by conducting supports applying the filament current, and in which insulating filament support means is provided intermediate the filaments.

10. An electron beam gun as claimed in claim 1 and in which supplemental selectively positioned beam shaping electrode means is provided for varying the electron beam contour emerging from the extractor grid.

11. An electron beam gun as claimed in claim 1 and in which a pair of longitudinally spaced transversely extending power bar conductors is provided, between successive transversely spaced opposing points of which a plurality of pairs of conductive supports depend for electrically parallely powering and mechanically supporting the successive corresponding filaments.

12. An electron beam gun as claimed in claim 11 and in which the said electrostatic lens surface is supported between the power bar conductors and the extractor grid mechanically depends from the electrostatic lens surface by insulating supporting holding means.

13. An electron beam gun as claimed in claim 11 and in which the filament conductive supports comprise terminal resilient clips for securing the filament ends.

14. An electron beam gun contained within an evacuated windowed housing for generating electron beam radiation for passage through the window along a direction transverse to the longitudinal direction of travel of a surface-to-be-irradiated external to said window having, in combination, a plurality of longitudinally extending parallel transversely spaced substantially co-planar similar filaments for generating electrons upon becoming heated by current passing simultaneously therethrough; a substantially planar extractor grid spaced on one side of the filaments and substantially coextensive with the area of the filaments and of polarity positive with respect to the filaments to draw the electrons generated thereby and maintain continuous acceleration in the said transverse direction to and through the grid; means for further continuously maintaining acceleration of the electrons to and through said window externally of said housing and upon said surface-to-be-irradiated; an electrostatic lens surface spaced on the other side of the filaments and substantially coextensive with the area of the filaments and of polarity with respect to the filaments such as to modify the flow of electrons from each filament to and through the extractor grid so as to provide electron beam shaping to generate a continuous transverse electron beam of desired uniformity and profile at said window, and in which the plurality of co-planar filaments is provided with one or more end filaments positioned out of the plane closer to the extractor grid for purposes such as obviating electron drop off effects.

15. An electron beam gun contained within an evacuated windowed housing for generating electron beam radiation for passage through the window along a direction transverse to the longitudinal direction of travel of a surface-to-be-irradiated external to said window having, in combination, a plurality of longitudinally extending parallel transversely spaced substantially co-planar similar filaments for generating electrons upon becoming heated by current passing simultaneously therethrough; a substantially planar extractor grid spaced on one side of the filaments and substantially coextensive with the area of the filaments and of polarity positive with respect to the filaments to draw the electrons generated thereby and maintain continuous acceleration in the said transverse direction to and through the grid; means for further continuously maintaining acceleration of the electrons to and through said window externally of said housing and upon said surface-to-be-irradiated; an electrostatic lens surface spaced on the other side of the filaments and substantially coextensive with the area of the filaments and of polarity with respect to the filaments such as to modify the flow of electrons from each filament to and through the extractor grid so as to provide electron beam shaping to generate a continuous transverse electron beam of desired uniformity and profile at said window, and in which the generated electron beam is accelerated to and through an anode window upon the said surface-to-be-irradiated, said window having an intermediate cooling channel region where electrons are blocked, and beam shaping electrode means disposed between the filaments and the extractor grid for reducing electrons in a region corresponding to said cooling channel region.

16. An electron beam gun contained within an evacuated windowed housing for generating electron beam radiation for passage through the window along a direction transverse to the longitudinal direction of travel of a surface-to-be-irradiated external to said window having, in combination, a plurality of longitudinally extending parallel transversely spaced substantially co-planar similar filaments for generating electrons upon becoming heated by current passing simultaneously therethrough; a substantially planar extractor grid spaced on one side of the filaments and substantially coextensive with the area of the filaments and of polarity positive with respect to the filaments to draw the electrons generated thereby and maintain continuous acceleration in the said transverse direction to and through the grid; means for further continuously maintaining acceleration of the electrons to and through said window externally of said housing and upon said surface-to-be-irradiated; an electrostatic lens surface spaced on the other side of the filaments and substantially coextensive with the area of the filaments and of polarity with respect to the filaments such as to modify the flow of electrons from each filament to and through the extractor grid so as to provide electron beam shaping to generate a continuous transverse electron beam of desired uniformity and profile at said window, and in which the generated electron beam is accerlerated to and through an anode window upon the said surface-to-be-irradiated, said window having an intermediate cooling channel region where electrons are blocked, and means intermediate the filament for cooling the same at a region corresponding to said cooling channel region.

17. An electron beam gun as claimed in claim 16 and in which said cooling means comprises an intermediate isolation filament support.

* * * * *